US011824266B2

(12) United States Patent
Fasenfest et al.

(10) Patent No.: US 11,824,266 B2
(45) Date of Patent: Nov. 21, 2023

(54) ENCAPSULATED MULTI-BAND MONOPOLE ANTENNA

(71) Applicant: Antcom Corporation, Torrance, CA (US)

(72) Inventors: Kathleen Fasenfest, Torrance, CA (US); Mike Taing, Anaheim, CA (US)

(73) Assignee: Antcom Corporation, Torrance, CA (US)

( * ) Notice: Subject to any disclaimer, the term of this patent is extended or adjusted under 35 U.S.C. 154(b) by 0 days.

(21) Appl. No.: 17/402,795

(22) Filed: Aug. 16, 2021

(65) Prior Publication Data

US 2022/0094076 A1 Mar. 24, 2022

Related U.S. Application Data

(60) Provisional application No. 63/082,028, filed on Sep. 23, 2020.

(51) Int. Cl.
*H01Q 21/20* (2006.01)
*H01Q 9/32* (2006.01)
(Continued)

(52) U.S. Cl.
CPC ..... *H01Q 21/20* (2013.01); *H01Q 9/0485* (2013.01); *H01Q 9/32* (2013.01); *H01Q 21/30* (2013.01)

(58) Field of Classification Search
CPC .... H01Q 1/2291; H01Q 1/405; H01Q 9/0442; H01Q 9/0492; H01Q 9/30; H01Q 9/32; H01Q 9/40; H01Q 21/06; H01Q 21/20; H01Q 21/26; H01Q 21/28; H01Q 21/29; H01Q 21/30; H01Q 11/10; H01Q 11/105; H01Q 9/0485; H05K 1/185; H05K 3/284; H05K 5/065; H05K 2201/09872; H05K 2203/13; H05K 2203/1305; H05K 2203/1316; H05K 2203/1322; H05K 2203/1327; H05K 2203/1377;
(Continued)

(56) References Cited

U.S. PATENT DOCUMENTS 2,275,030 A 3/1942 Epstein
6,094,178 A 7/2000 Sanford
(Continued)

FOREIGN PATENT DOCUMENTS

FR 2867617 A1 * 9/2005 ..... H01Q 15/0086
WO WO-03/058762 A1 7/2003
(Continued)

OTHER PUBLICATIONS

Erman, Fuad, et al., "Miniature Compact Folded Dipole for Metal Mountable UHF RFID Tag Antenna," MDPI, Electronics, journal, vol. 8, No. 713, Jun. 24, 2019, pp. 1-12.
(Continued)

*Primary Examiner* — Ab Salam Alkassim, Jr.
*Assistant Examiner* — Leah Rosenberg
(74) *Attorney, Agent, or Firm* — Cesari and McKenna, LLP

(57) ABSTRACT

An encapsulated multi-band monopole antenna is provided. Two or more sets of at least four monopole elements are encapsulated in a substrate. Conductive paths are arranged so that each element of a set of monopole element is connected to an element of each of the other sets of monopole elements.

17 Claims, 10 Drawing Sheets

(51) Int. Cl.
*H01Q 9/04* (2006.01)
*H01Q 21/30* (2006.01)

(58) Field of Classification Search
CPC ..... H01L 21/563; H01L 21/56; H01L 23/28; H01L 23/3121; H01L 31/048; H01L 33/52; H01L 2924/181; H01L 2924/15787
USPC ..... 174/521
See application file for complete search history.

(56) References Cited

U.S. PATENT DOCUMENTS

| | | | | |
|---|---|---|---|---|
| 6,288,682 | B1 * | 9/2001 | Thiel | H01Q 9/32 343/702 |
| 6,342,867 | B1 | 1/2002 | Bell | |
| 6,356,242 | B1 | 3/2002 | Ploussios | |
| 6,556,172 | B2 | 4/2003 | Noro | |
| 6,819,291 | B1 | 11/2004 | Lackey et al. | |
| 7,444,734 | B2 | 11/2008 | Gaucher et al. | |
| 7,570,219 | B1 * | 8/2009 | Paulsen | H01Q 9/0485 343/873 |
| 8,049,667 | B2 | 11/2011 | Lackey | |
| 10,935,687 | B2 * | 3/2021 | Ewe | G01V 3/38 |
| 2003/0016176 | A1 | 1/2003 | Kingsley et al. | |
| 2003/0117318 | A1 | 6/2003 | Champlain et al. | |
| 2004/0017327 | A1 | 1/2004 | Petropoulos | |
| 2006/0061512 | A1 | 3/2006 | Asano et al. | |
| 2008/0129617 | A1 * | 6/2008 | Li | H01Q 21/24 343/700 MS |
| 2011/0001680 | A1 * | 1/2011 | Leisten | H01Q 11/08 343/859 |
| 2014/0139384 | A1 | 5/2014 | Elliot et al. | |
| 2014/0266963 | A1 | 9/2014 | Fasenfest | |
| 2015/0042535 | A1 * | 2/2015 | Orban | H01Q 9/42 343/893 |
| 2017/0047665 | A1 | 2/2017 | Yang et al. | |
| 2021/0351501 | A1 * | 11/2021 | Hersh | H01Q 1/405 |

FOREIGN PATENT DOCUMENTS

| | | | |
|---|---|---|---|
| WO | WO-2020/171864 | A2 | 8/2020 |
| WO | WO-2020171864 | A3 | 8/2020 |

OTHER PUBLICATIONS

Janapsatya, Januar, et al., "Reducing the Height of a Circular Array of Monopoles Using Top Hats and Dielectric Coatings," American Geophysical Union, Radio Science, vol. 39, No. 3, RS3004, Jun. 2004, pp. 1-10.

Moghaddam, Elham Sharifi, et al., "Development of Separated Turnstile Antenna for Space Applications," IEEE, IEEE Antennas and Propagation Magazine, vol. 50, No. 4, Aug. 2008, pp. 84-93.

Paracha, Kashif Nisar, et al., "Liquid Metal Antennas: Materials, Fabrication and Applications," MDPI, Sensors, journal, vol. 20, No. 177, Dec. 28, 2019, pp. 1-26.

Puttre, Robert E., "Study of Small Omnidirectional 250-Mc Antenna for Penetrometer," Wheeler Laboratories, Inc., Report 1291, Final Report on Phase I, to National Aeronautics and Space Administration, Contract No. NAS 1-4470, Job 482, Jul. 29, 1965, pp. 1-99.

Tangdiongga, E., "Analysis of an Infinite Array of Microstrip Antennas Embedded in a Thick Substrate," Master, Thesis, TU/e Eindhoven University of Technology, Department of Electrical Engineering, Aug. 19, 1994, pp. 1-94.

Thalmann, Thomas, et al., "Investigation and Design of a Multi-band Wearable Antenna," IEEE, 2009 3rd European Conference on Antennas and Propagation, Berlin, Germany, Mar. 23-27, 2009, pp. 462-465.

Weinschel, H. D., "Design of Airborne S-Band Telemetry Antennas," International Foundation for Telemetering, International Telemetering Conference Proceedings, vol. 4, The University of Arizona, University Libraries, UA Campus Repository, Oct. 1968, pp. 1-13.

Zhou, Changfei, et al., "A Wideband Circularly Polarized Monopole Antenna Array," IEEE, 2015 IEEE International Symposium on Antennas and Propagation & USNC/URSI National Radio Science Meeting, Vancouver, BC, Canada, AP-S 2015, Jul. 19-24, 2015, pp. 1920-1921.

"European Search Report and Written Opinion," European Application No. 21194927.6-1205, Applicant: NovAtel Inc., dated Mar. 7, 2022, pp. 1-9.

* cited by examiner

ENCAPSULATED MULTI-BAND MONOPOLE ANTENNA

CROSS-REFERENCE TO RELATED APPLICATIONS

The present application claims the benefit of U.S. Provisional Patent Application Ser. No. 63/082,028, which was filed on Sep. 23, 2020, by Kathleen Fasenfest for ENCAPSULATED MULTI-BAND MONOPOLE ANTENNA, which is hereby incorporated by reference.

BACKGROUND

Technical Field

The present invention relates to multi-band antennas and, more particularly, to multi-band monopole antennas.

Background Information

Global Navigation Satellite Systems (GNSS) are well known in the art. A long-standing desire is to reduce the size of GNSS reception antennas to enable antenna integration into smaller devices and/or enclosures, e.g., handheld devices.

Examples of existing GNSS antenna types well known in the art include patch, helix, and inverted-F antennas. These conventional antenna designs do not meet miniaturization requirements while maintaining adequate performance for GNSS signal reception. GNSS patch antennas typically exhibit peak gain towards zenith with lower gain near the horizon, an undesirable feature for maintaining adequate signal reception for GNSS satellites located near the horizon. Axial-mode helical antennas offer higher gain at the horizon than zenith but require a taller height than a patch antenna with comparable gain, a limitation for miniature device integration. Inverted-F antennas support the size and gain requirements but are typically non-circularly polarized, reducing the capability of the GNSS system for rejecting multipath interference and degrading GNSS signal reception at some angles of sky coverage. While certain conventional antenna designs may be made small enough to fit desired size requirements, these designs typically are not multi-band capable with sufficient bandwidths in each operating band, may not exhibit circularly-polarized operation, and/or have lower antenna gain than required for adequate signal reception. This limits their use in smaller device and enclosure implementations, e.g., GNSS.

SUMMARY

The disadvantages of the prior art are overcome by the encapsulated multi-band monopole antenna of the present invention. The novel antenna comprises of two or more sets of monopole elements that are encapsulated by a substrate. Illustratively, each set of the monopole elements has a resonant frequency and the monopole elements from each set are electrically connected to produce a multi-band resonance. A conductive surface may be added to one of the surfaces of the substrate to add an additional resonant frequency.

The substrate material and dimensions are chosen so that the substrate also resonates, which adds gain to the antenna in directions that conventional monopole antennas do not have. Specifically, an exemplary antenna will have substantially the same gain at zenith as at the horizon, where conventional monopole antennas have a substantial gain reduction at zenith. The substrate is illustratively a high dielectric constant material with low dielectric loss. In an exemplary embodiment, the substrate is a polymer that is blended with ceramic, which improves the machinability of the substrate compared with conventional pure ceramic materials. This improved machinability reduces manufacturing costs.

BRIEF DESCRIPTION OF THE DRAWINGS

The above and further advantages of the present invention are described herein in conjunction with the accompanying figures, in which like reference numerals indicate identical or functionally similar elements, of which.

DETAILED DESCRIPTION OF AN ILLUSTRATIVE EMBODIMENT

Figure 1A:
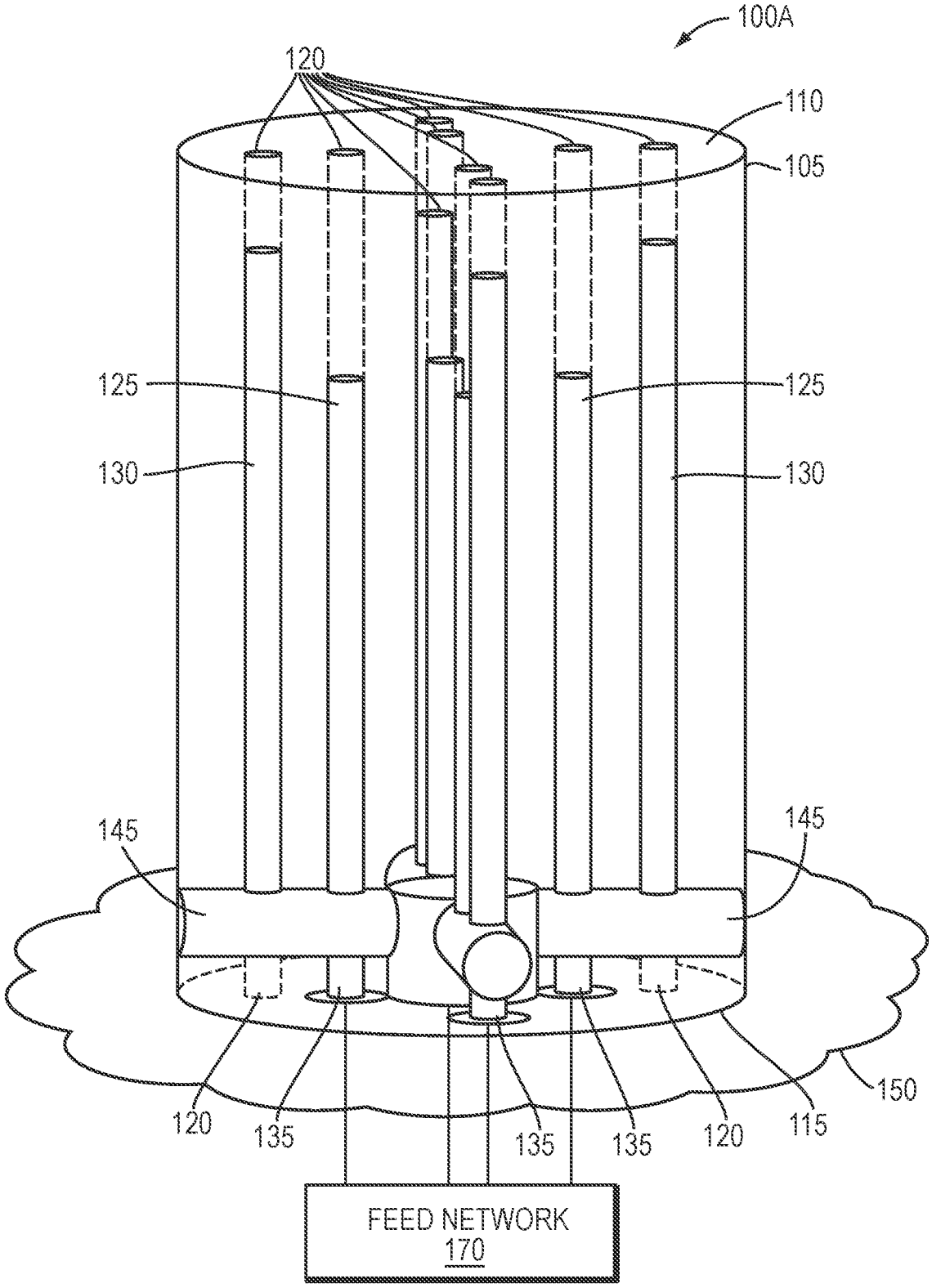
FIG. 1A is an isometric view of an exemplary antenna in accordance with an illustrative embodiment of the present invention.

FIG. 1A is an isometric view of an exemplary antenna 100A in accordance with an illustrative embodiment of the present invention. The exemplary antenna 100A comprises of a substrate 105 having a first surface 110 and a second surface 115. While the substrate 105 of antenna 100A is shown as being substantially cylindrical in shape, it should be noted that in accordance with alternative embodiments of the present invention, the substrate 105 may have alternative shapes. Therefore, the depiction of a substantially cylindrical substrate 105 should be taken as exemplary only.

The substrate illustratively has a high dielectric constant (e.g., 12) and a low dielectric loss (e.g., 0.001). The substrate is chosen so that it also resonates, thereby providing gain in a direction that a conventional monopole antenna would not have. Illustratively, this gain is directed along the axis of the antenna from the second surface to the first surface. One exemplary substrate is the PREPERM® PPE1200 material available from Premix Oy of Rajamaki, Finland. Another illustrative material is magnesium calcium titanate (MCT) series (MCT-30) material from Skyworks Solutions, Inc. of Woburn, Mass. In alternative embodiments, the substrate comprises of a polymer blended with ceramic. This exemplary substrate is easier to machine than conventional substrates, which simplifies manufacturing. Further, in alternative embodiments, the chosen exemplary substrate is substantially impervious to water ingress, which enables ease of use and obviates the need for a radome cover to protect the antenna.

The substrate's second surface 115 is substantially in alignment with an exemplary ground plane 150. Illustratively, the ground plane is made of a conductive material. As will be appreciated by those skilled in the art, the size and shape of the ground plane 150 may be modified to tune the antenna 100 depending on the desired frequency range(s) to be utilized. In exemplary installations, the antenna may be mounted onto a device (not shown) that may function as a ground plane. Therefore, the description of a ground plane should be taken as exemplary only.

A plurality of channels 120 are located within the substrate 105. In these channels 120 are located a first set of monopole elements 125 and a second set of monopole elements 130. A set of exemplary feed points 135 is provided that operational interconnect the antenna with a feed network 170. Illustratively, the first set of monopole elements 125 includes four monopole elements and are arranged so that they are approximately 90 degrees apart from each an adjacent element. Similarly, the second set of monopole elements 130 includes four monopole elements and are also arranged so that they are approximately 90 degrees apart from the adjacent element. Illustratively, the monopoles of each set of monopoles are arranged radially around an imaginary axis extending from the second surface to the first surface. Illustratively, the feed network 170 can combine the feed points with equal amplitude and quadrature phase progression to produce circularly-polarized GNSS signal reception.

It should be noted that while the exemplary antenna 100A shown and described in connection with FIG. 1A comprises of two sets of monopoles, each set having four monopoles, and arranged as a turnstile antenna, it is expressly contemplated that the teachings of the present invention may be used with antennas having varying numbers of sets of monopoles. Further, the number of monopoles in each set may vary. Additionally, the monopoles may be arranged in a non-turnstile configuration. Therefore, the description of an antenna having set sets of monopoles, with four monopoles per set, arranged as a turnstile antenna should be taken as exemplary only.

In accordance with an illustrative embodiment of the present invention, the channels 120 extend completely through the substrate, i.e., from the first surface to the second surface. In alternative embodiments, the channels may only extend as far as necessary to fit the monopole elements 125, 130. In further alternative embodiments, the channels may extend beyond the ends of the monopole elements 125, 130, but not all the way through the substrate. Therefore, the depiction of channels 120 extending through the substrate should be taken as exemplary only.

Four conductive paths 145 are shown. Each conductive path is illustratively in a lateral channel. Each conductive path is connected to a monopole of the first set of monopoles 125 and to a monopole of the second set of monopoles 130.

Figure 1B:
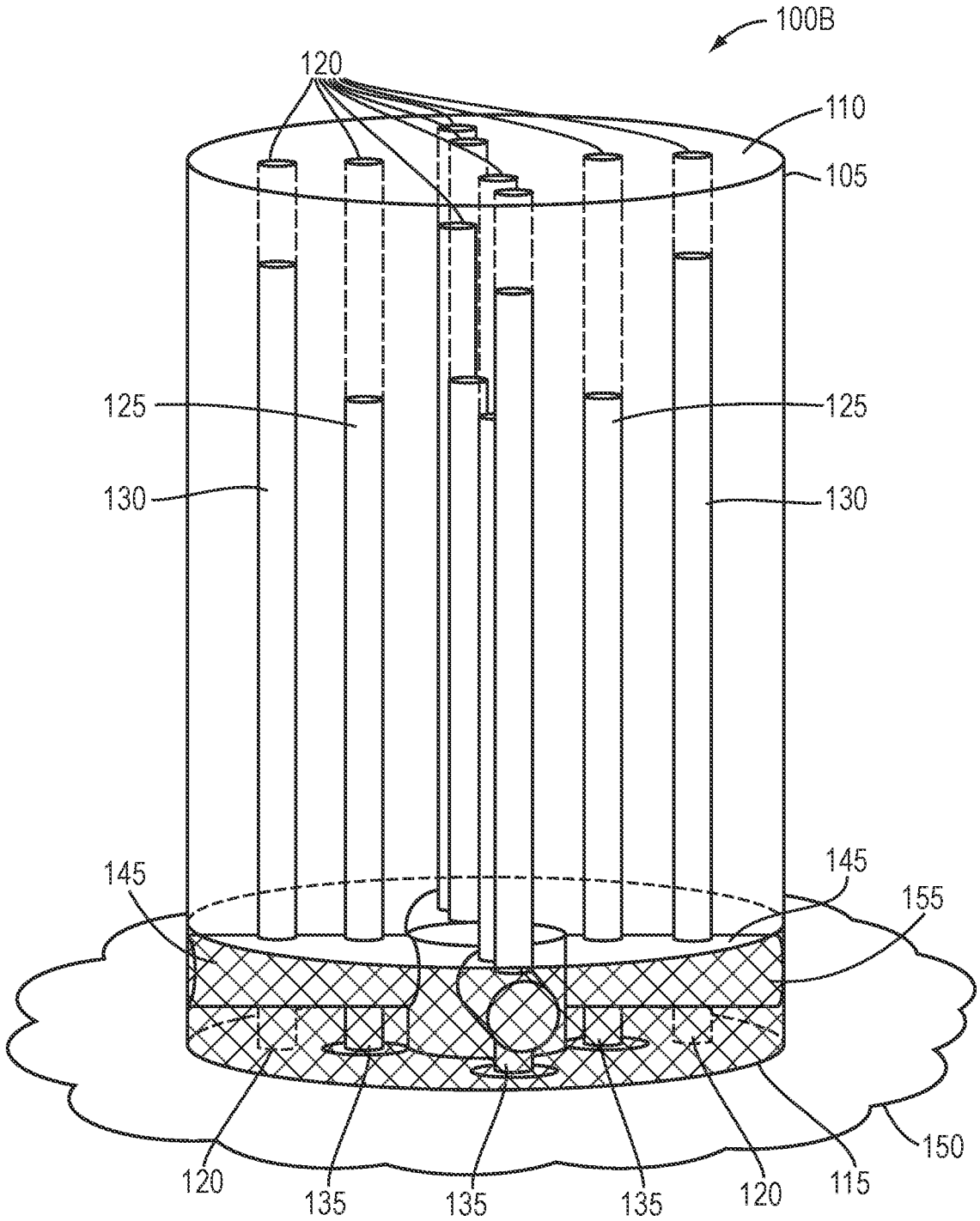
FIG. 1B is an isometric view of an exemplary antenna in accordance with an illustrative embodiment of the present invention.

FIG. 1B is an isometric view of an exemplary antenna 100B in accordance with an illustrative embodiment of the present invention. Exemplary antenna 100B is generally constructed that same as antenna 100B with the addition of a conductive ring 155 that is located around the exterior of the antenna 100B. Exemplary conductive ring illustratively extends from the ground plane 150 to just above the height of the conductive paths 145. It should be noted that this height is exemplary only and in alternative embodiments, differing heights may be utilized.

The conductive ring 155 provides capacitive coupling between the conductive ring 155 and the conductive paths 145. This addition may improve the antenna's gain by approximately 3 dB. Air gaps 165 (FIG. 2B) may be used to determine the capacitance. By adjusting the size of the air gaps 165, the increase capacitive coupling from the conductor 145 and the conductive ring 165 may reduce the size of the antenna 100B. Further, an improved impedance match may be obtained.

Figure 1C:
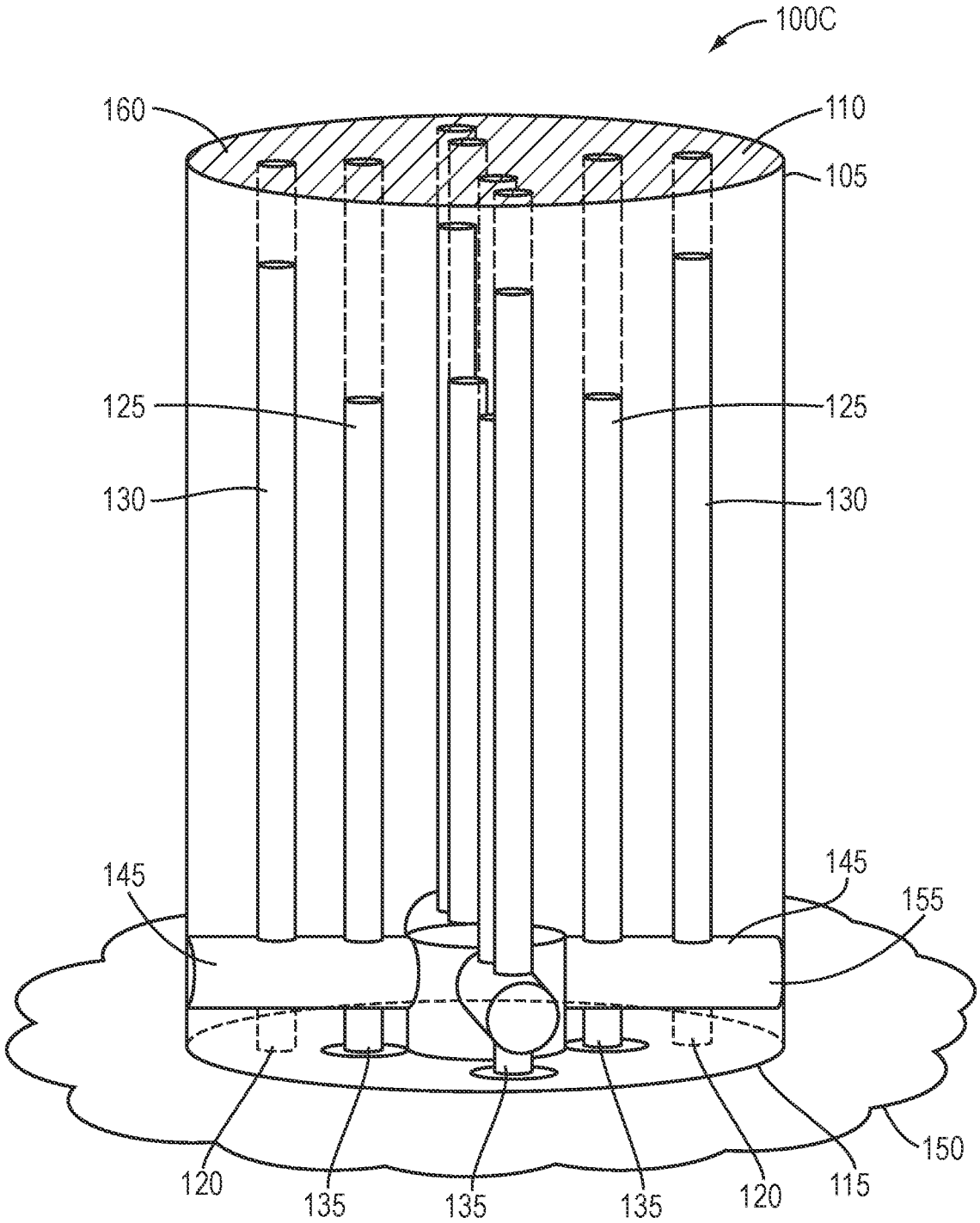
FIG. 1C is an isometric view of an exemplary antenna in accordance with an illustrative embodiment of the present invention.

FIG. 1C is an isometric view of an exemplary antenna 100C in accordance with an illustrative embodiment of the present invention. Antenna 100C includes a metal top 160 that is located at the top of the antenna. The addition of the metal top 160 serves to narrow the bandwidth of the antenna and enables the antenna to be made shorter. Illustratively, the addition of the metal top 160 works to tune the longest of the sets of monopole elements 125, 130. The narrowing of the bandwidth enables a high gain and/or a smaller physical form factor for the antenna, which is advantageous for size constrained applications, e.g., in a hand-held device.

Figure 2A:
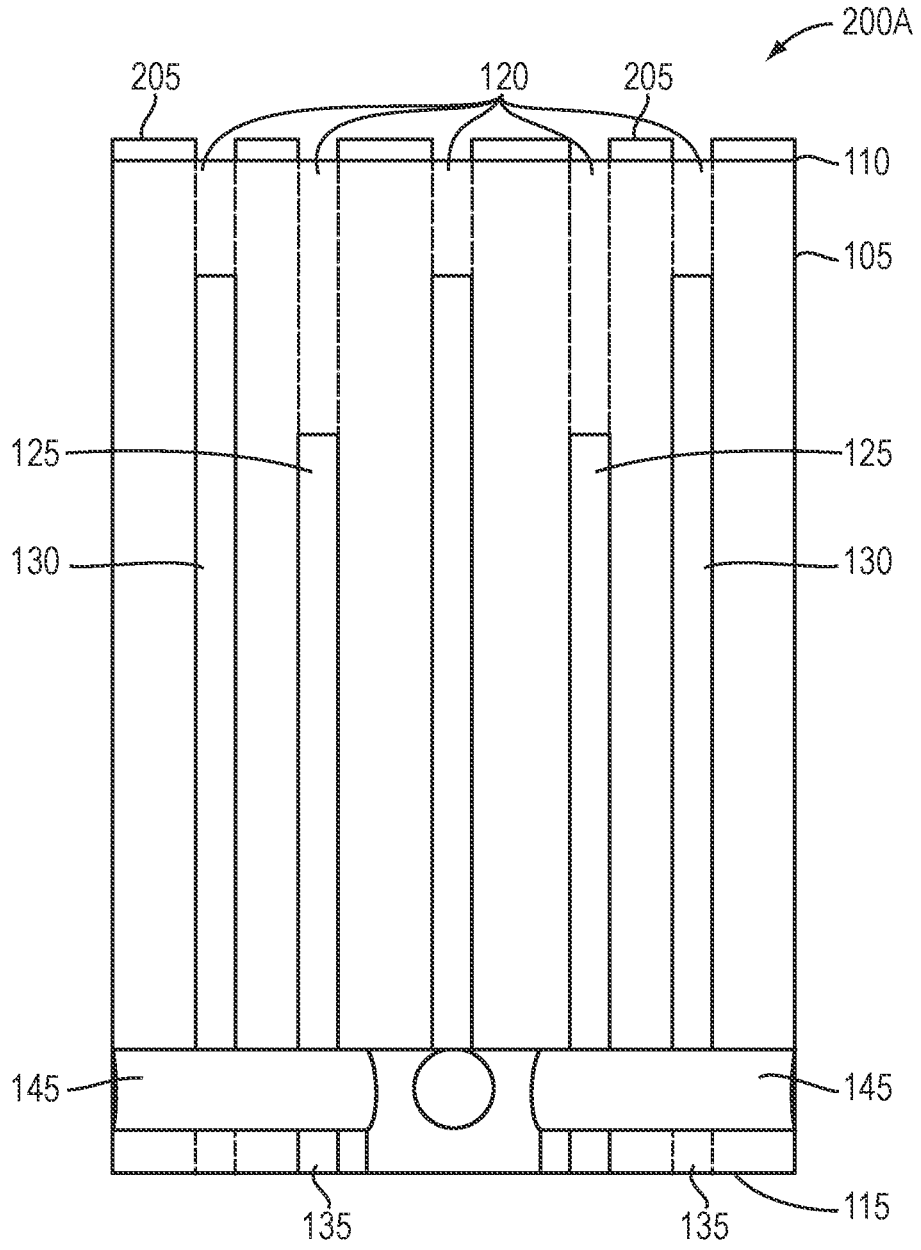
FIG. 2A is a side cross-sectional view of an exemplary antenna in accordance with an illustrative embodiment of the present invention.

FIG. 2A is a side cross-sectional view 200A of an exemplary antenna in accordance with an illustrative embodiment of the present invention. As can be seen, exemplary channels 120 extend from the first surface 110 to the second surface 115 of the antenna. In accordance with an exemplary embodiment of the present invention, a conductive layer 205 may be placed on the first surface 110. The conductive layer 205 may be utilized to provide an additional frequency of operation to the antenna. For example, the first and second monopole elements may operate at two GNSS frequencies, while the conductive layer 205 operates as a Wi-Fi frequency. Another example would be the first and second sets of monopoles being resonant on two GNSS frequencies, while the conductive layer 205 being resonant in the C-band. This enables further miniaturization of antennas for use in, e.g., handheld devices.

Figure 2B:
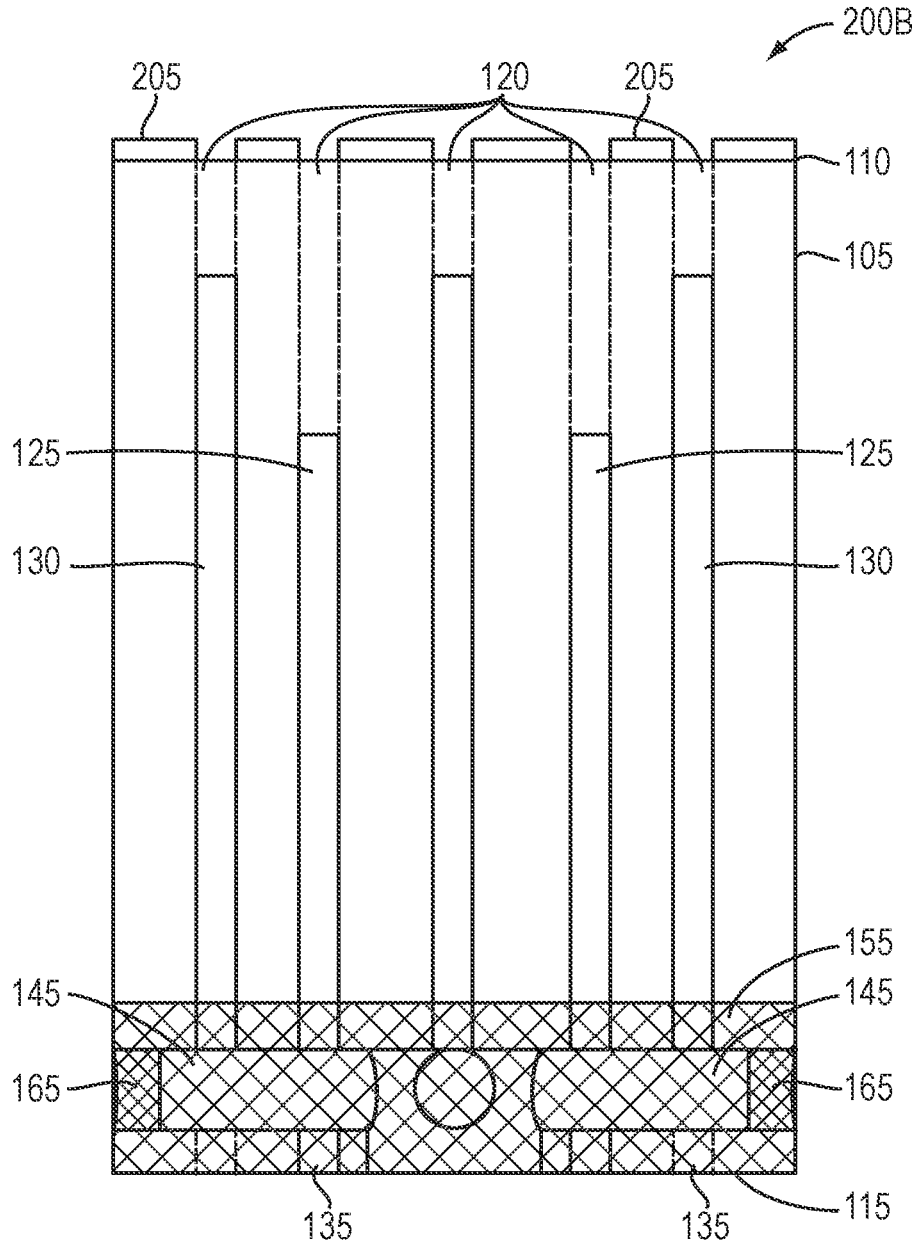
FIG. 2B is a side cross-sectional view of an exemplary antenna in accordance with an illustrative embodiment of the present invention.

FIG. 2B is a side cross-sectional view 200B of an exemplary antenna in accordance with an illustrative embodiment of the present invention. Antenna 200B illustrates the exemplary air gaps 165 and conductive ring 155. As noted above, the addition of the conductive ring 155 provides capacitance coupling between the conductive ring 155 and the conductors 145, which may reduce the size of antenna 200B and/or provide additional gain.

Figure 2C:
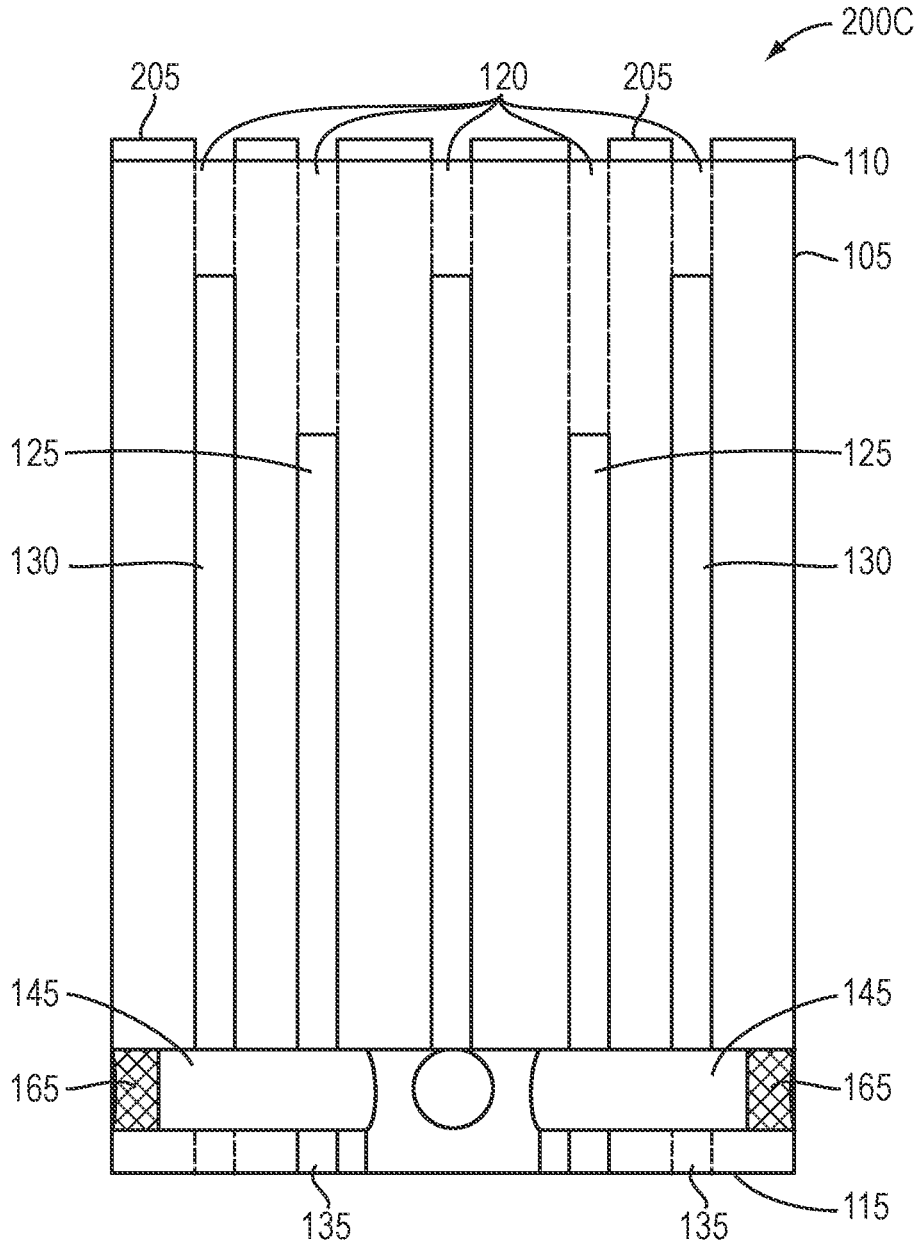
FIG. 2C is a side cross-sectional view of an exemplary antenna in accordance with an illustrative embodiment of the present invention.

FIG. 2C is a side cross-sectional view 200C of an exemplary antenna in accordance with an illustrative embodiment of the present invention. View 200C illustrates air gaps 165 at the end of the conductive paths 145. In accordance with alternative embodiments of the present invention, the conductive paths 145 may be utilized to tune the antenna. Illustratively, the conductive paths may be made of conductive adhesives or machined metal parts. Regardless of the construction, the length and/or diameter of the conductive paths 145 may be altered to tune the resonant frequencies of the antenna. This tuning technique enables simplified manufacturing. The monopole elements can remain at predetermined lengths, while the conductive paths 145 are altered to tune the antenna for variations in the substrate 105 permittivity.

Figure 2D:
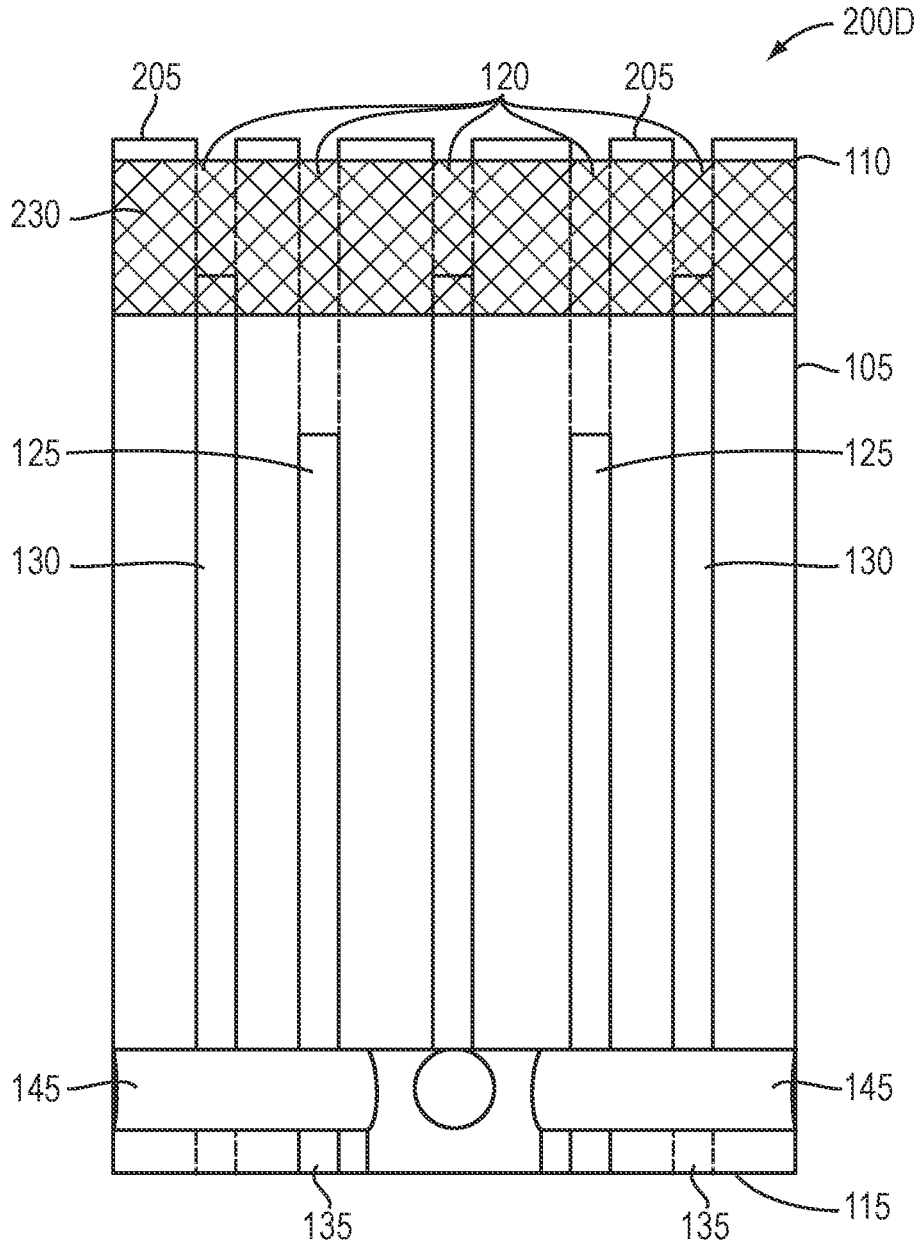
FIG. 2D is a side cross-sectional view of an exemplary antenna in accordance with an illustrative embodiment of the present invention

FIG. 2D is a side cross-sectional view 200D of an exemplary antenna in accordance with an illustrative embodiment of the present invention. View 200D illustrates an exemplary antenna that includes a metalized ring 230 at the top end of the antenna. Illustratively, the metalized ring 230 begins at the first surface 110 and extends along the sidewall of the antenna a short distance. This metalized ring may be used to reduce the overall height of the antenna. Illustratively, the metalized ring may extend approximately 0.1-0.2 inches along the antenna. However, it is expressly contemplated that it may extend other distances. Therefore, the description of 0.1-0.2 inches should be taken as exemplary only.

Similar to the metal top 160, the metallized ring 230 narrows the bandwidth of the antenna and allows its height to be shortened, which may be advantageous in size constrained applications. While the metal top 160 primarily tunes the longest of the sets of monopole elements 125, 130, the metallized ring 230 predominately tunes the second set of monopole elements 130.

While various embodiments have been described, it is expressly contemplated that in alternative embodiments, various features may be combined. For example, while the metal top 160, metallized ring 230, conductive ring 155 and air gaps 165 have each been described and shown separately, it is expressly contemplated that any of these embodiments may be combined with one or more of the illustrated embodiments. Therefore, the description of each embodiment separately should be taken as exemplary only.

Figure 3:
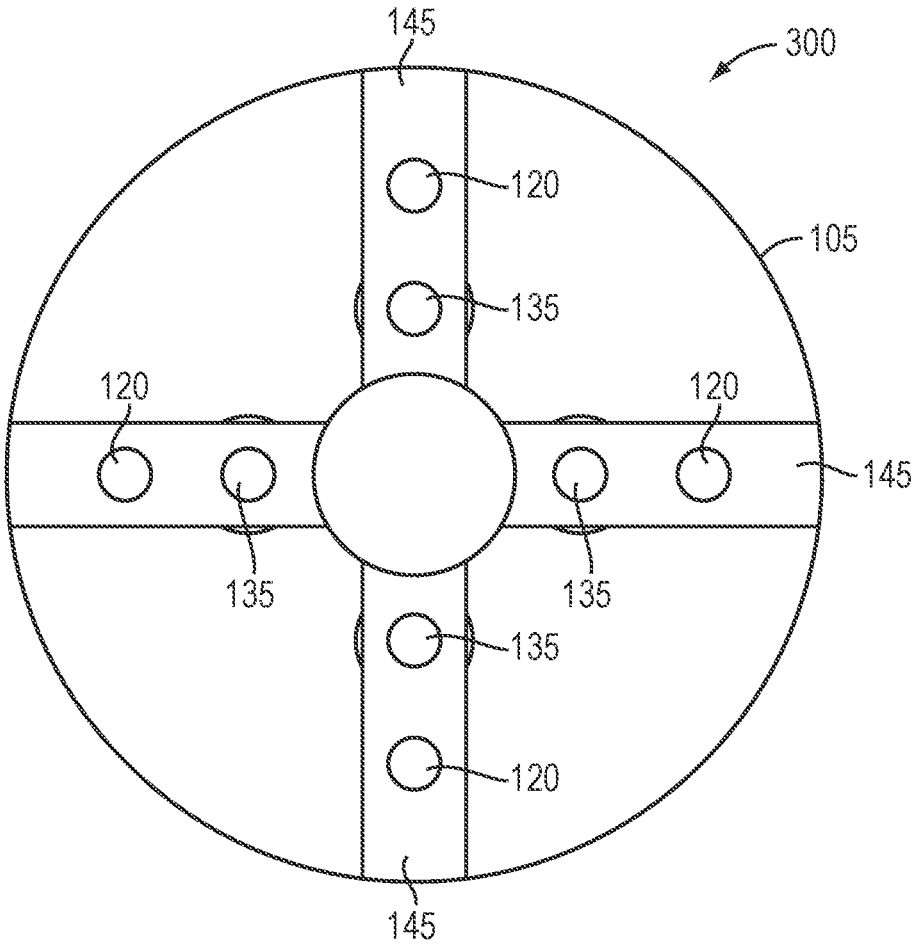
FIG. 3 is a bottom view of an exemplary antenna in accordance with an illustrative embodiment of the present invention.

FIG. 3 is a bottom view 300 of an exemplary antenna in accordance with an illustrative embodiment of the present invention. View 300 is exemplary taken from the viewpoint of the second surface. Exemplary channels 120 are shown along with feed points 135. The conductive paths 145 are shown.

Figure 4:
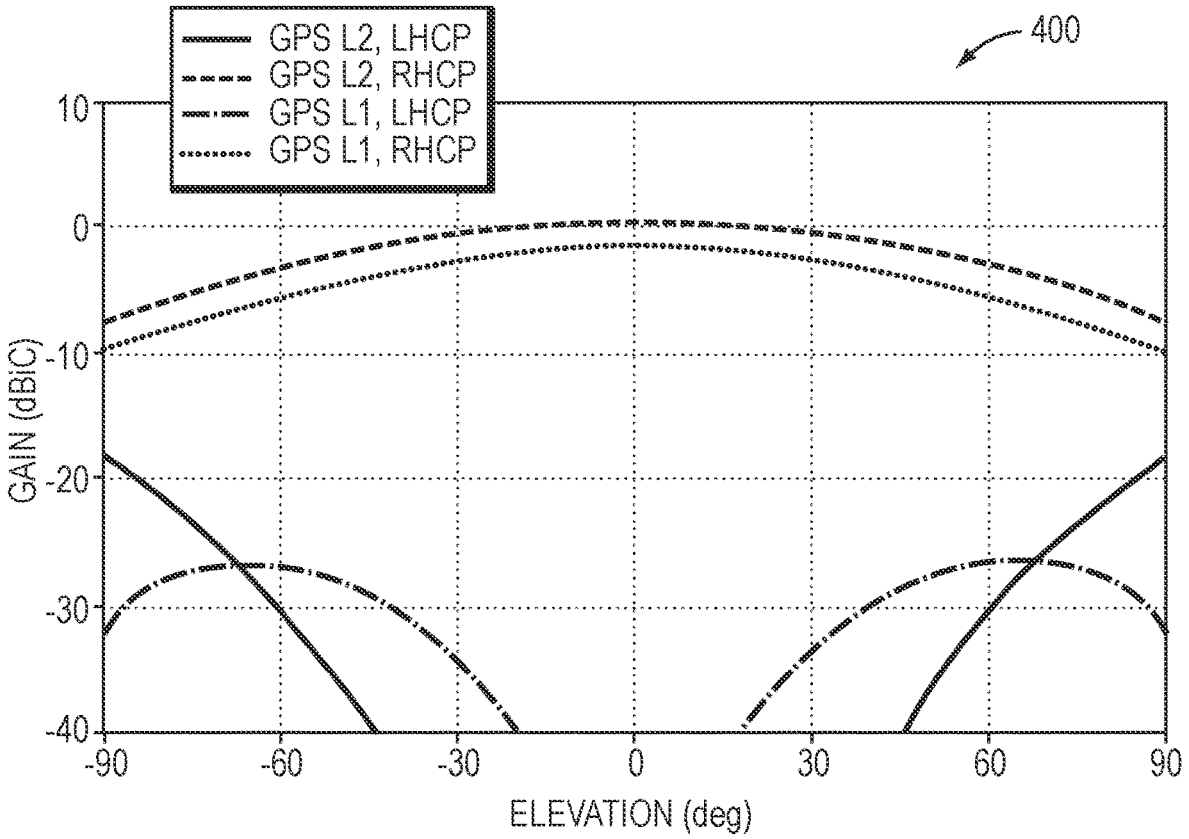
FIG. 4 is an exemplary graph illustrating gain versus elevation angle in accordance with an illustrative embodiment of the present invention.

FIG. 4 is an exemplary graph 400 illustrating gain versus elevation angle in accordance with an illustrative embodiment of the present invention. Exemplary graph 400 illustrates performance of an antenna constructed in accordance with the teachings contained herein and operating on two GNSS (GPS) frequencies. Notably, the antenna exhibits gain at the zenith, wherein conventional monopole turnstile antennas do not.

Figure 5:
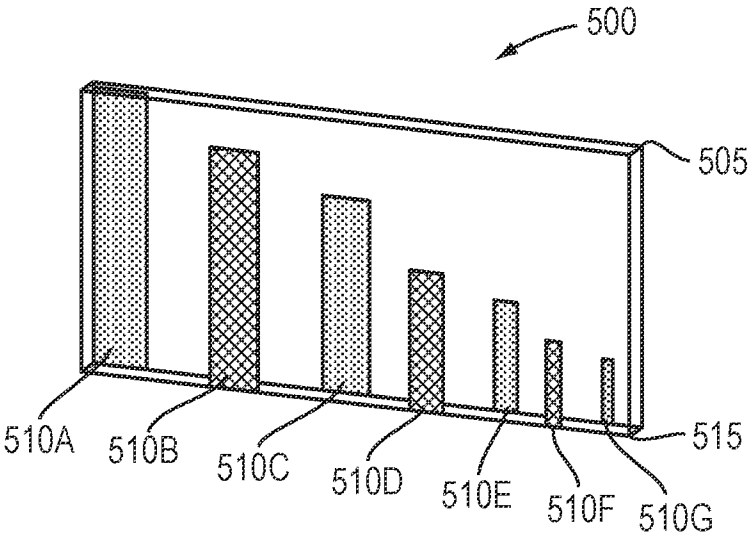
FIG. 5 is a perspective view of an exemplary log periodic monopole array in accordance with an illustrative embodiment of the present invention.

FIG. 5 is a perspective view 500 of an exemplary log periodic monopole array in accordance with an illustrative embodiment of the present invention. View 500 illustrates one exemplary technique for expanding the teachings of the present invention to use with more than two sets of monopoles. Illustratively, six monopole elements 510A-G are arranged on, e.g., a printed circuit board 505 as a log-periodic monopole array (LPMA). The use of a LPMA provides wideband use. A conductive path 515 can be located on a second surface to enable feeding of the LPMA.

Figure 6:
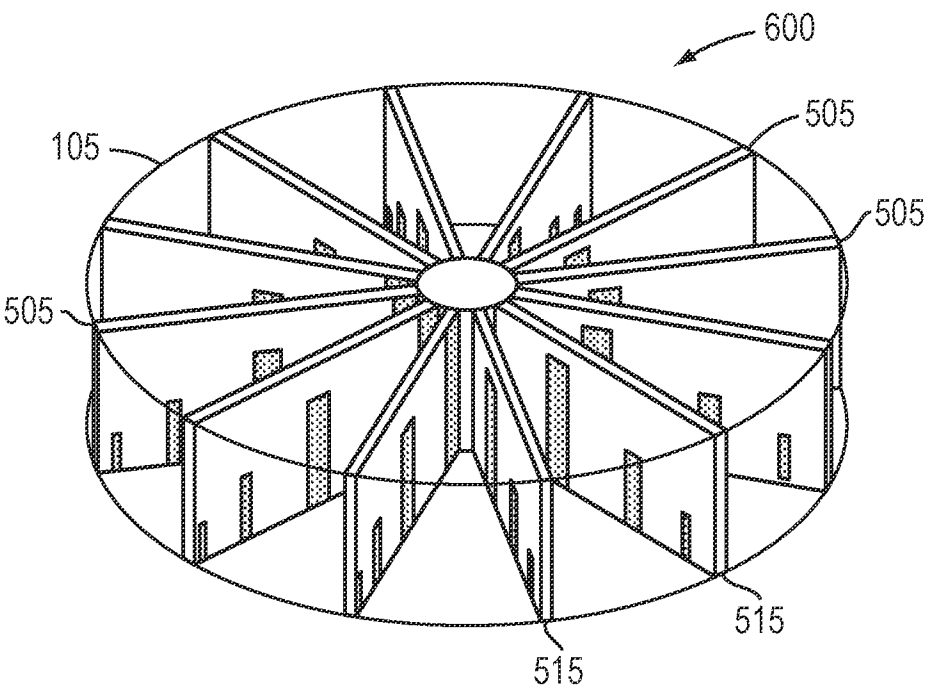
FIG. 6 is a perspective view of an exemplary antenna comprising of log periodic monopole arrays in accordance with an illustrative embodiment of the present invention.

FIG. 6 is a perspective view 600 of an exemplary antenna comprising of a plurality of LPMAs 505 in accordance with an illustrative embodiment of the present invention. In exemplary view 600, twelve LPMAs 505 have been arranged and then encapsulated in a substrate 505.

It should be noted that while specific sizes, dimensions, orientations, and materials have been shown and described herein, the principles of the present invention are not limited. It is expressly contemplated that the principles of the present invention may be implemented using other dimensions, orientations, and/or materials in accordance with alternative embodiments of the present invention. Therefore, the description contained herein should be viewed as exemplary only.

What is claimed is:

1. An antenna comprising:

a substrate having a first surface and a second surface;

a plurality of channels within the substrate;

a first set of monopole elements, each of the monopole elements of the first set made of a first conductive material and extending within one of the plurality of channels, the monopole elements of the first set are rotationally aligned around an imaginary axis of the substrate passing from the second surface to the first surface;

a second set of monopole elements, each of the monopole elements of the second set made of a second conductive material and extending within one of the plurality of channels, the monopole elements of the second set are rotationally aligned around the imaginary axis of the substrate passing from the second surface to the first surface;

a first conductive path connecting a first monopole element of the first set of monopole elements with a first monopole element of the second set of monopole elements;

a second conductive path connecting a second monopole element of the first set of monopole elements with a second monopole element of the second set of monopole elements, wherein the antenna is resonant at a first frequency and resonant at a second frequency; and a conductive ring disposed along an outside of the substrate, the conductive ring creating capacitive coupling with the first and second conductive paths.

2. The antenna of claim 1 wherein the conductive paths are arranged in a second set of channels in the substrate.

3. The antenna of claim 1 further comprising a conductive layer located on the first surface.

4. The antenna of claim 3 wherein the conductive layer adds a third resonant frequency to the antenna.

5. The antenna of claim 1 wherein the first set of monopole elements includes four monopole elements and wherein the second set of monopole elements includes four monopole elements.

6. The antenna of claim 5 wherein the first set of monopole elements are interconnected to a feed network combining output with equal amplitude and quadrature phase progression.

7. The antenna of claim 1 wherein the substrate is comprised of a polymer mixed with ceramic.

8. The antenna of claim 1 wherein the substrate is substantially impervious to water ingress.

9. The antenna of claim 1 further comprising a ground plane.

10. The antenna of claim 1 wherein the plurality of channels extend from the first surface to the second surface of the substrate.

11. The antenna of claim 1 wherein the first and second sets of monopole elements are arranged as a turnstile antenna.

12. The antenna of claim 1 wherein the first frequency is global positioning system (GPS) L1 frequency.

13. The antenna of claim 1 wherein the second frequency is global positioning system (GPS) L2 frequency.

14. The antenna of claim 1 wherein the antenna is configured to be tuned by modifying a length of the first and second conductive paths.

15. The antenna of claim 1 further comprising a metallized ring encircling the antenna or disposed at a predefined height beginning at the first surface.

16. The antenna of claim 1 further comprising a metal top disposed on the first surface.

17. The antenna of claim 1 further comprising a set of air gaps between outer ends of the first and second conductive paths and the conductive ring, wherein the capacitive coupling is configured to be controlled by a size of the set of air gaps.

* * * * *